US005505219A

United States Patent [19]

Lansberry et al.

[11] Patent Number: 5,505,219

[45] Date of Patent: Apr. 9, 1996

[54] SUPERCRITICAL FLUID RECIRCULATING SYSTEM FOR A PRECISION INERTIAL INSTRUMENT PARTS CLEANER

[75] Inventors: Don D. Lansberry, Kaysville, Utah; Thomas G. Council, Camarillo, Calif.

[73] Assignee: Litton Systems, Inc., Woodland Hills, Calif.

[21] Appl. No.: 344,031

[22] Filed: Nov. 23, 1994

[51] Int. Cl.[6] ..... B08B 3/02

[52] U.S. Cl. ..... 134/105; 134/111; 134/195; 134/198; 417/401

[58] Field of Search ..... 134/195, 196, 134/197, 111, 902, 198, 200, 105; 417/400, 401

[56] References Cited

U.S. PATENT DOCUMENTS

| | | | |
|---|---|---|---|
| 552,588 | 1/1896 | Rowley | 134/111 |
| 1,696,640 | 12/1928 | Lowthrop | 134/195 |
| 2,734,518 | 2/1956 | Harrison | 134/105 |
| 2,854,826 | 10/1958 | Johnston | 417/404 |
| 3,182,670 | 5/1965 | Howell | 134/111 |
| 3,234,746 | 2/1966 | Cope | 417/404 |
| 4,229,143 | 10/1980 | Pucher et al. | 417/404 |
| 4,304,529 | 12/1981 | Gerich | 417/404 |
| 4,785,836 | 11/1988 | Yamamoto | 134/195 |
| 5,013,366 | 5/1991 | Jackson et al. | 134/1 |
| 5,014,727 | 5/1991 | Aigo | 134/902 |

FOREIGN PATENT DOCUMENTS

| | | | |
|---|---|---|---|
| 3-223420 | 1/1991 | Japan | 134/902 |

*Primary Examiner*—Frankie L. Stinson
*Attorney, Agent, or Firm*—Wilfred G. Caldwell; James F. Kirk; Chester E. Martine

[57] ABSTRACT

Fluid cleaning apparatus for precision parts, comprising in combination, a chamber, having a fluid inlet and a fluid outlet, for holding parts to be cleaned and a fluid tight recirculating flow system including the chamber. The fluid tight system directs supercritical carbon dioxide fluid flow across the parts being cleaned. A fluid recirculating cylinder has a first fluid port and a second fluid port connected in the flow system. A fluid piston is in the cylinder between said ports. A pneumatic cylinder has a further piston between a first pneumatic port and a second pneumatic port. A driving member is connected between the pistons for reciprocal movement caused by air from a source alternately introduced to the pneumatic ports to cause the fluid piston to pump fluid through the chamber and back to the recirculating cylinder. A shuttle valve is connected between the air source and the pneumatic ports. Two actuators are responsive to different positions of the driving member for switching the shuttle valve alternately to direct air from the supply to the pneumatic ports and exhaust used air. A plurality of one way valves are in the system to insure that the fluid pumped by the piston exhibits unidirectional flow through the chamber. A filter is connected in the fluid flow system upstream of the chamber.

10 Claims, 4 Drawing Sheets

SUPERCRITICAL FLUID RECIRCULATING SYSTEM FOR A PRECISION INERTIAL INSTRUMENT PARTS CLEANER

This invention was developed under U.S. Government Contract N00030-94-C-001, thereby affording the U.S. Government certain rights.

BACKGROUND OF THE INVENTION

1. Field of the Invention

The invention uses carbon dioxide, in the supercritical fluid range, for cleaning parts, and particularly precision parts for inertial instruments by employing fluid recirculation, and fluid filtering.

2. Prior Art

Supercritical fluid systems are widely known, both for cleaning purposes and for extracting purposes, such as extracting caffeine from the coffee bean or removing nitroglycerine from gun powder. However, no recirculating supercritical fluid systems are known. Also, no such systems permitting fluid filtering are known.

The prior art is characterized by low volume, low pressure systems incapable of providing high pressure, e.g., 3000 psi recirculating fluid systems capable of fluid filtering.

One source of prior art supercritical fluid systems is:

C. F. Technologies, Inc.

Hyde Park, Mass. 02136.

SUMMARY OF THE INVENTION

The invention comprises a supercritical fluid tight high pressure, high volume recirculating flow system, including a precision parts chamber connected to receive the fluid flow. A fluid recirculating cylinder and piston serve as a high pressure pump for the system. A pneumatic cylinder has a piston reciprocally driven from an air supply source. A rigid driving shaft or member is connected between the two pistons to impart reciprocal motion to the fluid piston.

A plurality of one way valves in the recirculating flow system insures unidirectional fluid flow through the parts chamber, from opposite ends of the fluid cylinder, alternately, but continuously.

A shuttle valve is provided to automatically introduce air from the supply alternately to opposite ends of the pneumatic cylinder and permit exhausting of the used air.

A pair of pneumatic actuators are spaced apart adjacent to the driving shaft, and are respectively triggered by a plate or protrusion carried by the shaft at locations corresponding to the ends of the piston strokes, for shifting the shuttle valve to permit pumping in both directions of piston travel.

The preferred fluid pressure in the system is about 3000 psi, but the system may be capable of 4000–5000 psi. Nozzles may be employed in the chamber to provide thorough cleaning through greater turbulence of all contaminants, even if deposited in tiny cracks at these pressures. The nozzles uniquely direct the high volume high pressure fluid across the parts for superior cleaning. Also, the unidirectional flow permits the use of a filter upstream of the chamber.

The system further includes a heater on the downside of the chamber fluid flow to maintain the supercritical condition. A flow metering valve intentionally introduces a pressure drop just before the extractor to turn the fluid to gas and cause separation out of the contaminants and solvents. The gas is then exhausted.

DESCRIPTION OF THE PREFERRED EMBODIMENT

Figure 1:
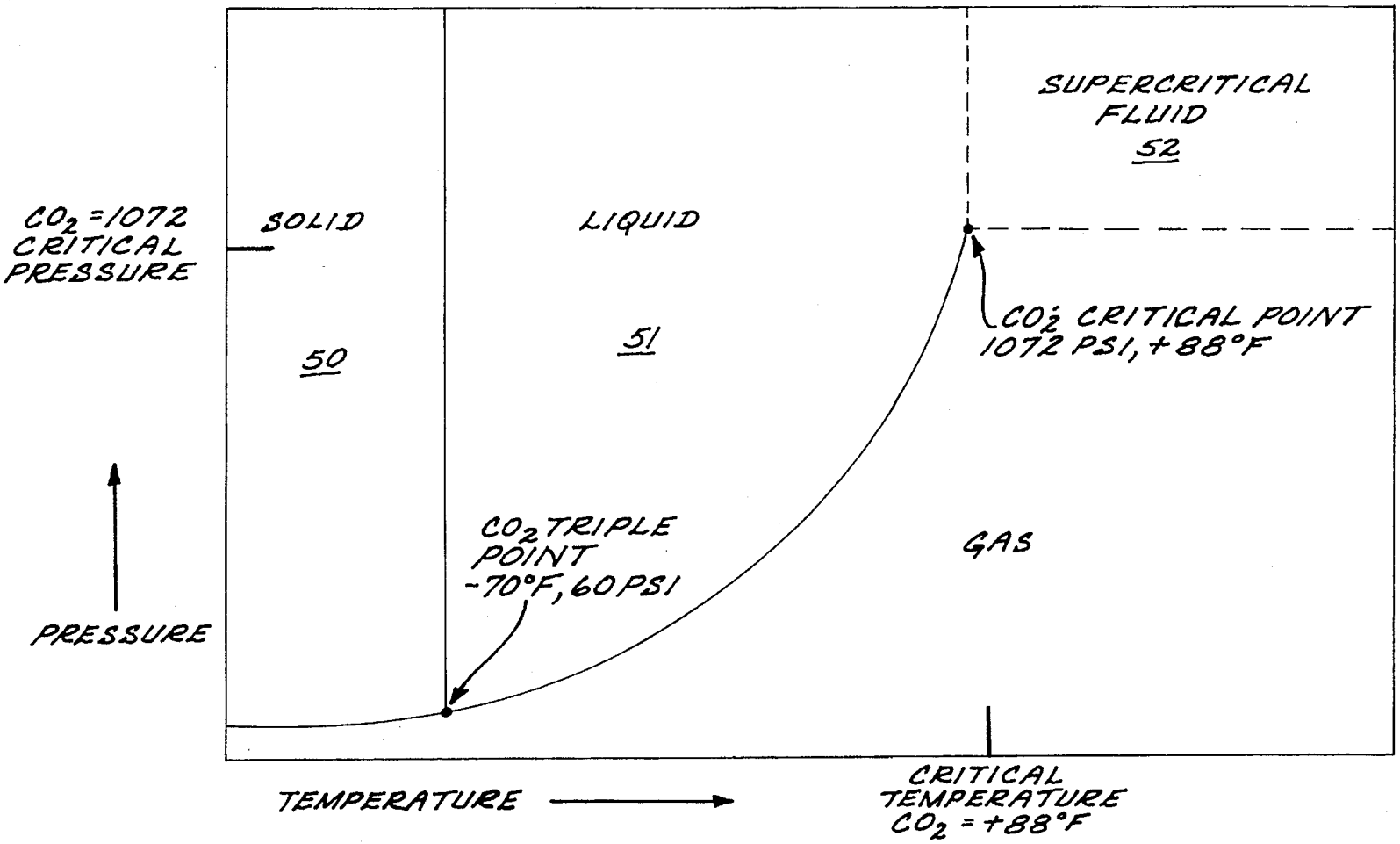
FIG. 1 is a supercritical pressure v. temperature chart for carbon dioxide.

Previously, freon and trichloromethane were the solvents of choice for cleaning of precision gyro and accelerometer parts used in inertial navigation systems. Supercritical $CO_2$ is emerging as one of the non-ozone depleting, ecologically correct cleaning substitutes.

Motion of the fluid over the parts greatly enhances the cleaning action. The usual approach for movement of supercritical fluid such as $CO_2$ in a high pressure cleaning system, is to use a magnetically coupled stirring rod. Problems immediately evident using stirring are: 1) Fluid is somewhat random in its movement over the parts and is not concentrated where needed nor is it throttleable. 2) Magnetically sensitive inertial instrument parts are subjected to unnecessary magnetic fields. 3) The stirrer is in the bottom of the cleaning chamber and tends to stir up the sediment generated in the cleaning process.

Fluid circulation/recirculation via an external device has a number of advantages: 1) Fluid can be directed to specific areas of the parts being washed via nozzles. 2) Circulation can be readily throttled. 3) Directed velocities of the fluid are higher thus providing a better scrubbing action. 4) The recirculating fluid can be constantly filtered to remove particulates. 5) Filtering allows less overboard purging of the chamber to remove the contamination. The end result is a cleaner part and a more economical use of $CO_2$.

There are various methods of providing recirculation. A vane pump that will withstand pressures of up to 5000 psi is almost non-existent. A wobble plate type hydraulic pump depends on the lubricating qualities of the fluid being pumped. Supercritical fluids are typically cleaners and thus not only do they not provide lubrication, but further would remove any lubrication present.

An oscillating cylinder is a natural candidate being an inherently high pressure device. The oscillation frequency is only a few strokes per minute so teflon seals work well. The power required to drive the system is only that required to overcome the friction of the seals and the impedances of the check valves, nozzles and filter. The pressure on both ends of the cylinder is very nearly equal so no work is required to overcome the high pressure. A flip flop drive cylinder actuated by shop air is sufficient to provide drive.

The system is mechanized as follows. The pneumatic drive cylinder 21 (FIG. 2) provides the required oscillating force to drive the recirculating piston 23'. The shuttle valve 24, in the position shown, provides air pressure to port A' of the cylinder 21 and vents port B' forcing the drive piston 21' to the right. Upon reaching the end of its travel the collar 26 on the shaft 31 reverses the shuttle valve 24. This pressurizes port B' and vents port A' causing the piston 21' to reverse direction forcing the drive piston 21' to the left. Upon reaching the other end, the shuttle valve 24 moves back the other way.

In general, air entering the pneumatic drive cylinder 21 (see FIG. 2) moves the recirculating cylinder 23 piston back and forth producing fluid motion. When moving to the left it pulls fluid from the cleaning chamber 25 into port C through check valve E. At the same time fluid is being forced out of port D through check valve F, then through the filter 27 and the nozzles 29 and onto the parts (not shown) being cleaned. When the cylinder reaches its left limit of travel and reverses, it pulls fluid from the cleaning chamber 25 into port D through check valve G. At the same time fluid is being forced out of port C through check valve H, then through the filter 27 and the nozzles 29 back onto the parts. This provides the required unidirectional flow through the filter 27 and nozzles 29.

In greater detail, piston 23' of recirculating cylinder 23 is rigidly connected to piston 21' of pneumatic cylinder 21 by rod 31 so that movement of pneumatic piston 21' powers fluid piston 23' to pump fluid through the system to clean any parts in chamber 25.

A shop air supply of e.g. 100 psi is applied to inlet conduit 33, and supplies air through moveable connection 35 (of shuttle 24) to port A' to drive piston 21' to the right to exhaust air via port B' and shuttle connection 37 to exhaust air at 39.

Figure 4:
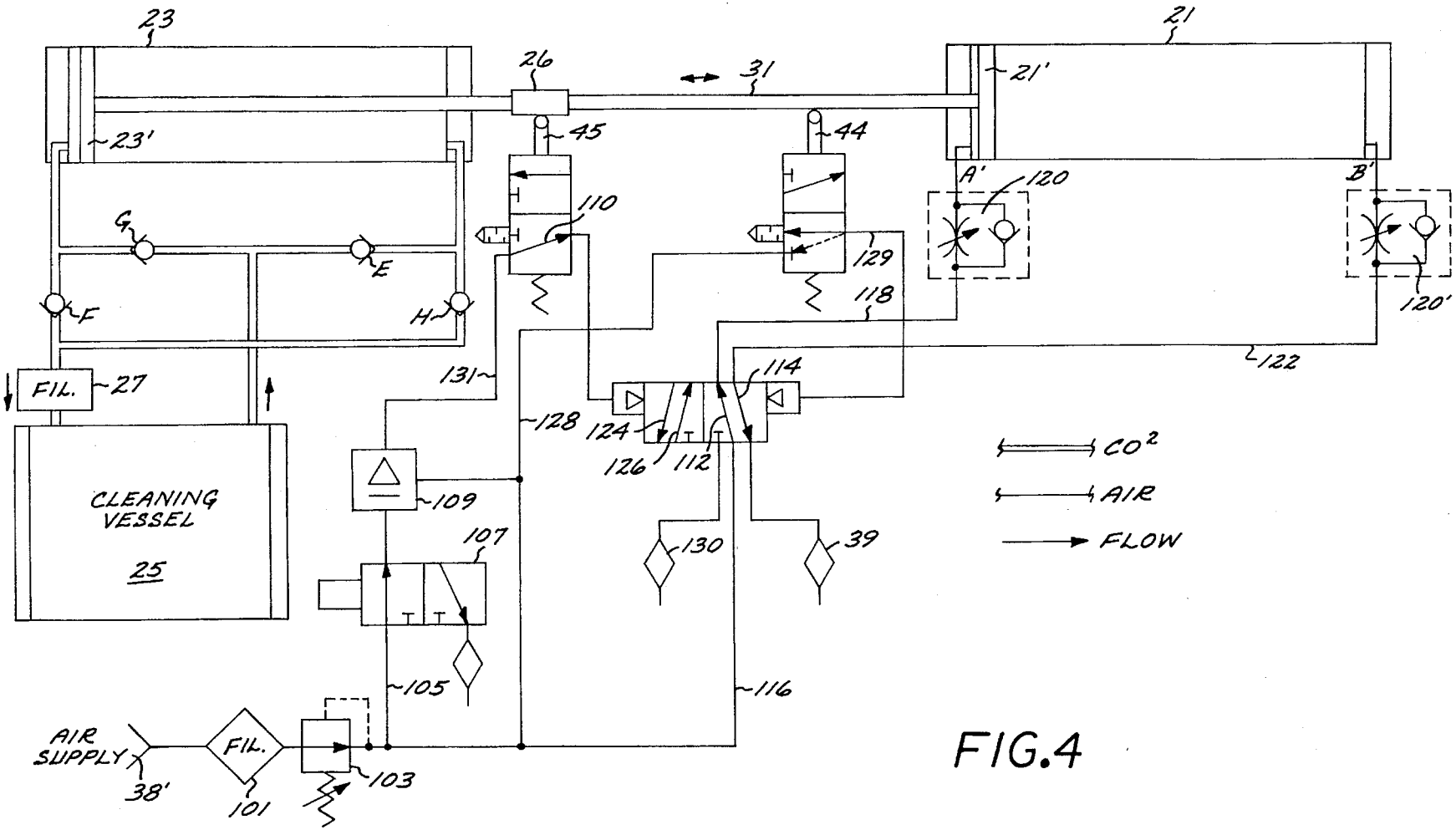
FIG. 4 is a preferred component layout of both the supercritical recirculation fluid flow system and the pneumatic powering system; and, FIG. 5 is an improved nozzle layout for the invention.

When collar 26 reaches trigger 41 for shuttle valve 24, the valve is switched and the air supply is connected over conduit 43 to connection 37 to reverse the drive and send piston 21' to the left, until collar 26 strikes trigger 45, again to reverse the drive to apply air pressure to port A'. Thus, piston 21' continuously reciprocates in driving direction, to power the fluid system. Triggers 41 and 45 are spaced apart by one stroke length as shown in FIG. 4.

In the fluid system, piston 23', when moving to the left, forces fluid out port D, through one way valve F, and then through filter 27, nozzle 29 and into chamber 25. The recirculating fluid path extends along fluid path 47 to one way valve E and into cylinder 23 via port C.

When piston 23' is caused to move to the right, fluid is pumped out of cylinder 23 via port C and via one way valve H, through filter 27, nozzle 29 and into chamber 25. The return is through conduit 47, one way valve G and into port D of cylinder 23. In this manner, unidirectional fluid flow is dictated through chamber 25.

In FIG. 1, the solid, liquid, gas and supercritical regions are designated at 50, 51, 53 and 52. For the portion of the flow system described in FIG. 2, the supercritical fluid was always maintained in region 52 by maintaining the fluid pressure at or above 1072 psi and the temperature at or above 88 degrees F.

Figure 3:
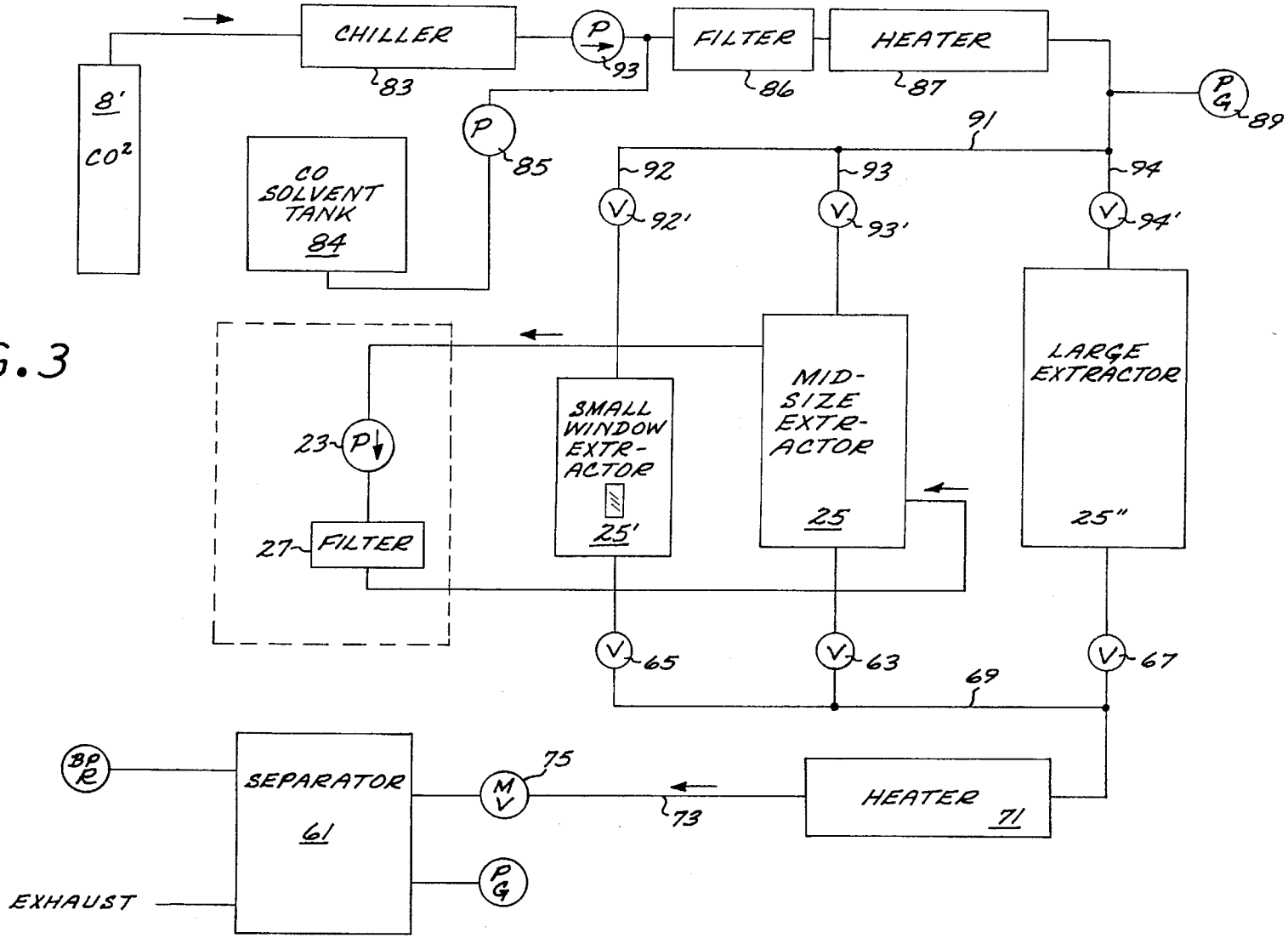
FIG. 3 is an overall layout of the carbon dioxide system from supply tank through the supercritical flow system to the gaseous extractor and discharge but omits showing some components visible elsewhere, such as the one way valves, etc.

In FIG. 3, the separator 61 (bottom left) is provided to drop out the contaminants and solvents from the gaseous state of the carbon dioxide. Bottom fluid from the compartments 25, 25' and 25" are tapped off through outlet valves 63, 65 and 67 to common conduit 69 and go to heater 71. This added heat prevents the fluid from leaving its supercritical state or region.

The heated fluid (at about 3000 psi) from heater 71 follows conduit 73 to flow metering valve 75 where a pressure drop is experienced producing a gaseous state (See FIG. 1, region 53) as the gas (at about 750 psi) enters separator 61 to drop the contaminants and solvents. The used gas is exhausted through back pressure regulator 77.

The source of carbon dioxide gas is tank 81 (FIG. 3). It is liquid at room temperature and regulates itself because gas is released if pressure goes down. Thus a typical tank cylinder 4' high by 9" diameter will stay at approximately 835 psi between full and empty and will last for about two hours and complete two cleanings. This $CO_2$ liquid is cooled in chiller 83 to about 55 to 60 degrees F. and introduced to high pressure low volume pump 93 where the pressure is raised to about 3000 psi for the recirculation system. A co-solvent tank 84 and high pressure low volume pump 85 in parallel may be added, if desired. The system will operate on pure $CO_2$, but co-solvents, such as acetone or alcohol or other conventional solvents can be added to the $CO_2$ to dissolve additional contaminants or additional materials. Typically only one or two percent co-solvents are employed. The high pressure low volume pumps are Haskel pumps, model APB 860 from the Haskel pump company of Burbank, Calif. The purpose of the pump 85 is to raise the $CO_2$ pressure to 3000 psi for injection into the system. The purpose of the pump 93 is to raise the co-solvent pressure to 3000 psi for injection into the system when a co-solvent is desired.

Filter 86 filters the incoming charging fluid. Both filters 27 (FIGS. 2 and 3) and filter 86 are filter/Autodrain F3000-Ion-F ⅜ NPT from Miller.

The supercritical fluid is then applied to heater 87 where the temperature is brought to about 160 degrees F. at the desired 3000 psi, indicated on pressure gauge 89.

From heater 87, the liquid $CO_2$ follows conduit 91, and thence down branch conduits 92, 93 and 94 to charge the system with fluid. Inlet valves 92', 93' and 94' control the initial fluid supply to small window extractor 25', mid-size extractor 25 and large extractor 25".

Figure 2:
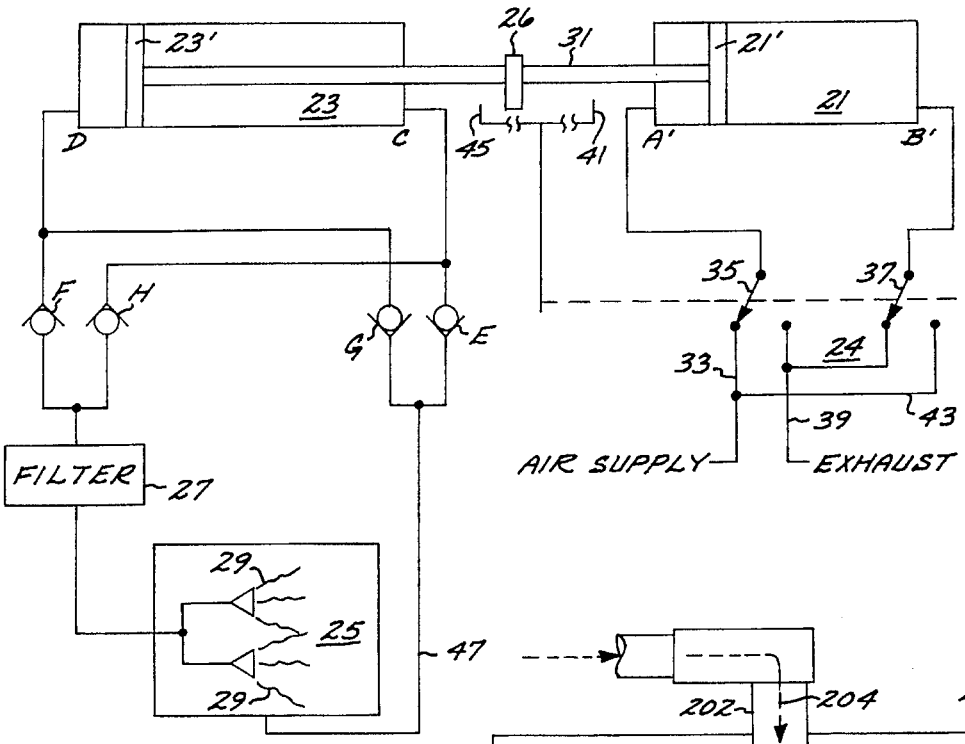
FIG. 2 is a schematic flow chart of the recirculating fluid system powered by a reciprocating pneumatic motor or driver.

The recirculating system is shown by pump cylinder 23 of FIG. 2 and filter 27. The recirculating cylinder 23 and pneumatic drive cylinder 21 are used in FIG. 3, as explained in the description of FIGS. 2 and 4.

The preferred embodiment for a single compartment extractor is shown in FIG. 4 wherein the supercritical cleaning compartment is shown at 25 where it actually is built to withstand 4000 psi although the usual operating pressure is 3000 psi. This is easily accomplished by using a steel cylinder with a screw type door for parts passage. The compartment may be purchased from C. F. Technologies, Inc.

The recirculating pump comprising cylinder 23 and piston 23' is built to withstand 4000 psi, also, and may be purchased from Miller Fluid Power, 800 N. York Rd., Bensenville, Ill. 60106-1183, as a heavy duty tie rod 6" stroke cylinder (the same is true for pneumatic cylinder 1). Also, the Teflon® seals for the rod 31 are available from Miller Fluid Power.

The momentary limit switch reversing valves 45, 41 are also available from Miller. Referring to FIG. 4, in the position shown, valve 45 (Miller 600-92-1701) is actuated by protrusion 26, and in its actuated state, as shown, it connects air supply 38', over filter 101 (Miller filter/Autodrain F3000-Ion-F) through regulator 103, (Miller ⅜ NPT) up conduit 105, through solenoid 107 (Miller solenoid operated valve 5/32" diameter push type) and via YES logic element 109 (Miller YES element 600-50-1025 to passage 110 to shuttle pilot operated valve (Miller 5/32 diameter push type) 24 to cause the shuttle valve to move all connections to the right, as shown by connections 112 and 114. This brings input air from conduit 116, connection 112, conduit 118 and through flow control valve 120 (Miller 340 Flo-4, ½ NPT).

This enables air pressure to be applied through port A' (FIG. 2 and 4) to start piston 21' moving to the right. The exhaust of cylinder 21 moves via port B', conduit 122, shuttle connection 114 to exhaust 39 (Miller muffler 331-424).

Again referring to FIG. 4, when protrusion 26 strikes trigger 41, shuttle valve 24 is moved to the left (the transferred state) because shuttle connection 129 momentarily receives air from conduit 128, and exhausts port A' over 124 to exhaust 130. Shuttle connection 126 applies air through the now transferred shuttle valve 24, from conduit 116 to port B'. Thus, the pneumatic drive automatically reciprocates.

The logic element 109 is a stop element to disconnect the air supply from the trigger valves, 41, 45.

Flow control valves 120, 120', Miller 340-Flow-4 (½ NPT) regulate the flow of the inlet and exhaust air to cylinder 21 to control the speed of the stroke by adjusting the flow.

Figure 5:
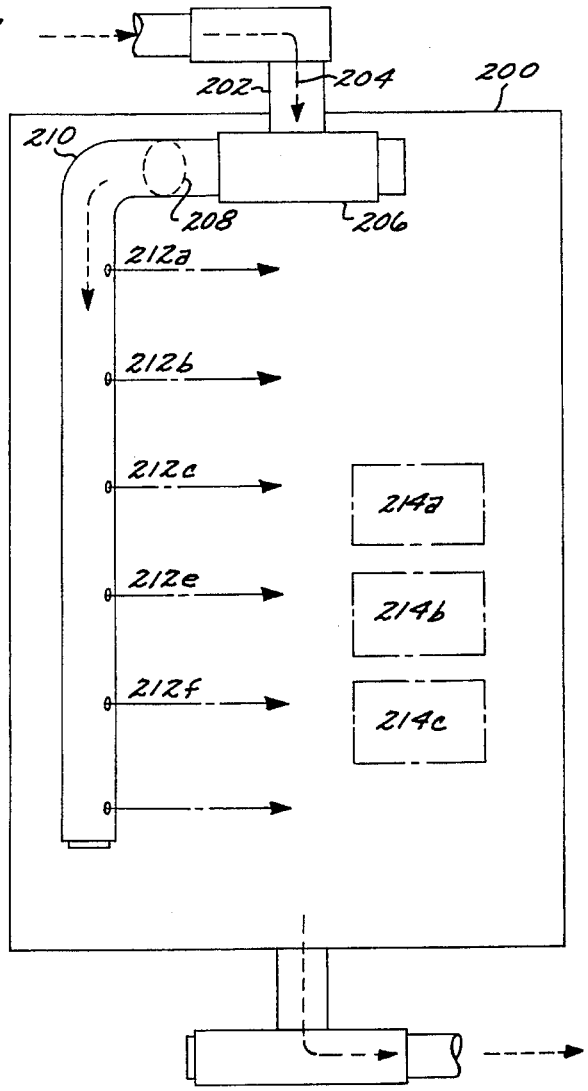

FIG. 5 shows a multi-level spray nozzle 210 vertically disposed in chamber 200, corresponding to 25, 25' or 25", or any one thereof. Incoming unidirectional fluid follows arrow 204, down conduit 202 into standpipe 210, via coupling 206. Six sprays are shown as 212*a* to 212*f* at different levels for better cleaning of parts 214*a*, 214*b* and 214*c*. The cross sectional area of the pipe bore identified as 208 should be equal to or greater than the cumulative or the total area of the bore holes of all of the sprays.

Although the invention has been disclosed and illustrated in detail, it is to be understood that the same is by way of illustration as an example only and is not to be taken by way of limitation. The spirit and scope of this invention is to be limited only by the terms of the appended claims.

What is claimed is:

1. Precision parts cleaning apparatus using supercritical carbon dioxide fluid for cleaning precision parts, comprising, in combination:

a chamber for holding said parts to be cleaned and having a fluid inlet and a fluid outlet;

a fluid tight recirculator flow system, including said chamber, for directing fluid flow across said parts to be cleaned;

a source of carbon dioxide gas;

pressure pump means and heater means connected to the source to change the gas to supercritical fluid and introduce the fluid to the recirculator flow system for movement by said system;

a recirculating cylinder having a first fluid port and a second fluid port connected in said flow system;

a piston in said cylinder;

a driving member connected to said piston; a pneumatic motor for moving the driving member and said piston back and forth;

one way valves in said fluid flow system to insure that fluid is driven from the cylinder ports through the chamber unidirectionally to clean said parts, and back to the cylinder ports; and, a filter connected in the fluid flow system upstream of the chamber.

2. The apparatus of claim 1 wherein:

said motor comprises a pneumatic cylinder and piston with said piston rigidly connected to the recirculating piston by said driving member whereby pressures of about 3000 pounds per square inch are introduced into and moved through the flow system to even clean in cracks in said parts.

3. The apparatus of claim 2 further comprising:

nozzles for the fluid entering said parts chamber for establishing turbulence in the chamber to improve cleaning of the parts.

4. The apparatus of claim 3 further comprising:

a two position air valve shuttle for directing air against one side of the pneumatic piston for one stroke and against the other side of the piston for the successive stroke; and means responsive to the position of said driving member to switch said shuttle to reverse the driving member direction.

5. Fluid cleaning apparatus for precision parts, comprising in combination:

a chamber, having a fluid inlet and a fluid outlet, for holding parts to be cleaned;

a fluid tight recirculating flow system including said chamber for directing supercritical carbon dioxide fluid flow across the parts being cleaned;

a source of carbon dioxide gas;

pressure pump means and heater means connected to the source to change the gas to supercritical fluid at about 3000 pounds per square inch and introduce the fluid to the recirculating flow system for movement by said system;

a fluid recirculating cylinder having a first fluid port and a second fluid port connected in said flow system;

a fluid piston in said cylinder between said ports;

a pneumatic cylinder having a further piston between a first pneumatic port and a second pneumatic port;

a driving member connected between said pistons for reciprocal movement caused by air from a source alternately introduced to said pneumatic ports to cause the fluid piston to pump fluid through said chamber due to the driving member and back to the recirculating cylinder;

a shuttle valve connected between the air source and pneumatic ports;

actuators responsive to different positions of the driving member for switching the shuttle valve alternately to direct air from the supply to the pneumatic ports alternately and exhaust used air;

a plurality of one way valves in the system to insure that the fluid pumped by said piston exhibits unidirectional flow through the chamber; and, a filter connected in the fluid flow system upstream of the chamber.

6. The apparatus of claim 5, further comprising:

at least one spray nozzle in said chamber connected to receive supercritical carbon dioxide fluid from the recirculating cylinder via the filter and spray it across said parts.

7. The apparatus of claim 5 wherein:

a first fluid path of said system extends from the first fluid port of the recirculating cylinder through a first one way valve to the filter;

a second fluid path of said system extends from the chamber outlet through a second one way valve to the second fluid port of the recirculating cylinder;

a third fluid path of the system extends from the second fluid port of the recirculating cylinder through a third one way valve to the filter; and a fourth fluid path of the system extends from the chamber outlet through a fourth one way valve to the first fluid port of the recirculating cylinder.

8. The apparatus of claim 7 wherein:

the recirculating cylinder has a first stroke when the piston thereof is moved toward the first fluid port and a second stroke when the piston thereof is moved toward the second fluid port;

said first and second fluid paths establishing circulation of the fluid through the system during the first stroke, and said third and fourth fluid paths establishing circulation of the fluid through said system during the second stroke.

9. The apparatus of claim 8 wherein:

an extractor is connected to receive output fluid from said chamber converted into gas by a pressure drop in order to remove contaminants and solvents from said system.

10. Fluid cleaning apparatus for precision parts, comprising in combination:

a chamber, having a fluid inlet and a fluid outlet, for holding parts to be cleaned;

a spray nozzle in the chamber to receive said fluid;

a fluid tight recirculating flow system including said chamber and nozzle for directing supercritical carbon dioxide fluid flow across the parts being cleaned;

a source of carbon dioxide gas;

pressure pump means and heater means connected to the source to change the gas to supercritical fluid at about 3000 pounds per square inch and introduce the fluid to the flow system for movement by said system;

a fluid recirculating cylinder having a first fluid port and a second fluid port connected in said flow system;

a fluid piston in said cylinder between said ports;

a pneumatic cylinder having a further piston between a first pneumatic port and a second pneumatic port;

a driving member connected between said pistons for reciprocal movement caused by air from a source alternately introduced to said pneumatic ports to cause the fluid piston to pump fluid through said chamber and back to the recirculating cylinder;

a shuttle valve connected between the air source and pneumatic ports;

actuators responsive to different positions of the driving member for switching the shuttle valve alternately to direct air from the supply to the pneumatic ports alternately and exhaust used air;

a plurality of one way valves in the system to insure that the fluid pumped by said piston exhibits unidirectional flow through the chamber; and, a filter connected in the fluid flow system upstream of the chamber.

* * * * *